US005821475A

United States Patent [19]

Morehead et al.

[11] Patent Number: 5,821,475

[45] Date of Patent: Oct. 13, 1998

[54] VENTURI MUFFLER WITH VARIABLE THROAT AREA

[75] Inventors: Clyde A. Morehead; John W. Henry, V, both of Annapolis, Md.

[73] Assignee: The United States of America as represented by the Secretary of the Navy, Washington, D.C.

[21] Appl. No.: 646,571

[22] Filed: May 8, 1996

Related U.S. Application Data

[63] Continuation-in-part of Ser. No. 309,520, Sep. 20, 1994, Pat. No. 5,530,214.

[51] Int. Cl.[6] ..... F01N 1/00

[52] U.S. Cl. ..... 181/255; 181/229; 138/46

[58] Field of Search ..... 181/237, 241, 181/246, 247, 248, 249, 250, 255, 282, 224, 229, 230, 403; 138/40, 44, 45, 46

[56] References Cited

U.S. PATENT DOCUMENTS

| | | | |
|---|---|---|---|
| 4,690,245 | 9/1987 | Gregorich et al. | 181/249 |
| 4,693,339 | 9/1987 | Beale et al. | 181/229 |
| 5,137,439 | 8/1992 | Lundin | 181/229 |
| 5,174,113 | 12/1992 | Deville | 138/40 X |
| 5,530,214 | 6/1996 | Morehead et al. | 181/255 |

*Primary Examiner*—Khanh Dang
*Attorney, Agent, or Firm*—Howard Kaiser

[57] ABSTRACT

The invention is directed to a muffler for a gas flow at a gas intake of a machine. The muffler includes at least one venturi nozzle cooperating with a chamber. Each venturi nozzle has an inlet opening, an outlet opening and a throat therebetween. The chamber has a chamber inlet connected to either the inlet opening or the outlet opening of each venturi nozzle. The chamber has a chamber outlet connected to the gas intake of the machine. Some embodiments of the invention feature variation of the total throat area of the muffler. Other embodiments of the invention feature variation of the volume enclosed by the chamber.

13 Claims, 3 Drawing Sheets

VENTURI MUFFLER WITH VARIABLE THROAT AREA

CROSS REFERENCE TO RELATED APPLICATIONS

This application is a continuation-in-part of co-owned applications Ser. No. 08/309,520, filed Sep. 2, 1994, now U.S. Pat. No. 5,530,214 issued 25 Jun. 1996. +gi

STATEMENT OF GOVERNMENT RIGHTS

The invention described herein may be manufactured and used by or for the Government of the United States of America for governmental purposes without the payment of any royalties thereon or therefor.

BACKGROUND OF THE INVENTION

1. Field of Invention

The present invention relates generally to mufflers, and more particularly to mufflers that attenuate low frequency noise generated at the gas intake of compressors, internal combustion engines and other machines that produce noise during the process of taking in air or other gases.

2. Brief Description of Related Art

Machines such as air compressors and internal combustion engines —especially diesel engines —produce high level pulsations at multiples of the machine's rotational frequency range. Mufflers used to reduce intake pulsation noise generally are dissipative or reactive or a combination of the two. To be effective at low frequencies (i.e., below about 500 Hz) and over a broad frequency range, these types of mufflers must be very large and heavy. Most reciprocating compressors generally have first order pulsation frequencies in the 7 to 20 Hz range and produce significant intake noise at multiples of the pulsation frequency up to frequencies in the 300–400 Hz range. However, even large mufflers can generally only attenuate tones by less than about 6 dB below about 30 Hz. To compensate for such low frequency deficiencies, tuned filters may be designed for the low frequencies. However, the tuned filters are effective only over a very limited frequency range.

SUMMARY OF THE INVENTION

Accordingly, it is an object of the present invention to provide a muffler that attenuate low frequency noise generated at the gas intake of a machine.

Another object of the present invention is to provide a muffler that attenuate noise generated over a broad range of frequencies at the gas intake of a machine.

It is still a further object of the present invention to provide a muffler suitable for use with various machines having a range of capacities.

It is yet a further object of the present invention to provide a muffler able to be optimized for a machine having a variable intake flow.

Other objects and advantages of the present invention will become apparent to those skilled in the art upon a reading of the following detailed description taken in conjunction with the drawings and the claims supported thereby.

In accordance with the present invention, these objects are met by providing a muffler for connecting to a gas intake of a machine that produces noise while taking in a gas flow through the gas intake. The present muffler attenuates low frequency noise generated at the gas intake of the machine. The muffler includes at least one venturi nozzle cooperating with a chamber. Each of the at least one venturi nozzles has corresponding inlet and outlet openings and a venturi throat therebetween. The muffler has a total throat area associated therewith and includes means for varying the total throat area. The chamber has a chamber volume associated therewith and may include means for varying the chamber volume. The chamber further has a chamber inlet connected to either the inlet opening or the outlet opening of the at least one venturi nozzle. Additionally, the chamber has a chamber outlet connected to the gas intake of the machine. Flow of the gas reaches the gas intake by sequentially passing from the inlet opening of the at least one venturi nozzle, through the at least one venturi nozzle, through the outlet opening of the at least one venturi nozzle, through at least a portion of the chamber, and through the chamber outlet.

In one embodiment of the present invention the at least one venturi nozzle is made of a flexible elastic material, the corresponding venturi throat is circular in cross-section, and the means for varying the total throat area includes an adjustable collar surrounding the corresponding venturi throat for constricting the venturi throat.

In an alternate embodiment of the present invention the at least one venturi nozzle includes first and second parallel sides, and first and second flared sides orthogonal to the parallel sides. The first and second flared sides include parallel sections defining the corresponding venturi throat, convergent sections from the corresponding inlet opening to the corresponding venturi throat, and divergent sections from the corresponding venturi throat to the corresponding outlet opening. The means for varying the total throat area includes means for moving at least one of said first and second flared sides towards said other one of said first and second flared sides.

In a further alternate embodiment of the present invention the at least one venturi nozzle comprises a plurality of venturi nozzles, each of the plurality of venturi nozzles including corresponding inlet and outlet openings and a venturi throat therebetween, each of the corresponding venturi throats has a cross-sectional area associated therewith. The total throat area associated with the muffler is defined by the combined cross-sectional areas of the venturi throats. The means for varying the total throat area includes means for closing the corresponding inlet opening of at least one of the plurality of venturi nozzles.

Generally, the machine to which the present muffler is connected is of the type requiring a known volume of a gas at its gas intake during each intake cycle wherein noise arises during each intake cycle. Thus, in a further embodiment of the present invention, the at least one venturi nozzle includes inlet and outlet openings, and further includes a throat passage between the inlet and outlet openings, a converging section between the inlet opening and the throat passage and a diverging section between the throat passage and the outlet opening. The throat passage is sized to increase an average speed of a flow of the gas to between about 0.7 times sonic velocity and sonic velocity. Additionally, the volume defined by the chamber and the diverging section of the at least one venturi nozzle is equal to between about 1 and 10 times the known volume of one intake cycle.

BRIEF DESCRIPTION OF THE DRAWINGS

The foregoing objects and other advantages of the present invention will be more fully understood by reference to the following description taken in conjunction with the accompanying drawings wherein like reference numerals refer to like or corresponding elements throughout and wherein.

DETAILED DESCRIPTION OF THE PREFERRED EMBODIMENT

Figure 1:
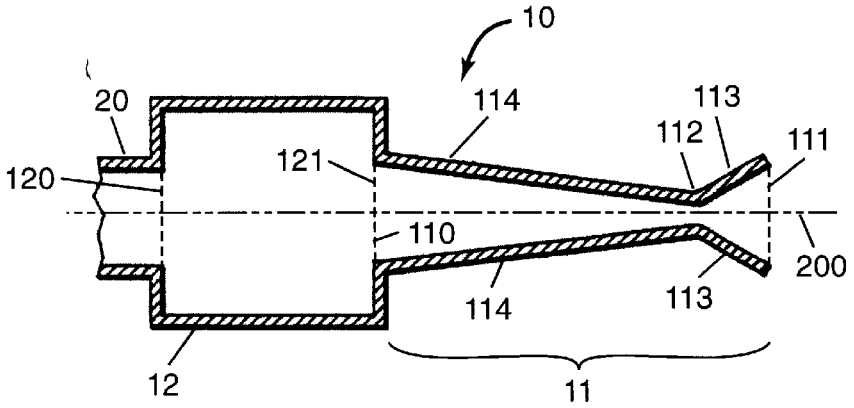
FIG. 1 is a side, cross-sectional view of a muffler according to one embodiment of the present invention.

Referring now to the drawings, and more particularly to FIG. 1, one embodiment of muffler 10 is shown in cross-section. Muffler 10 consists of at least one venturi nozzle 11 connected to chamber 12. Muffler 10 has a total throat area associated therewith and includes means 115 for varying the total throat area (shown in FIGS. 4–7). Outlet 120 of chamber 12 (indicated by the dashed line tagged with reference numeral 120) is connected to intake 20 of a machine (not shown) such as an air compressor (e.g., piston or screw type), internal combustion engine or any other machine that produces noise while taking in air or other gases through intake 20. Accordingly, the present invention will be described as it relates to low frequency acoustic noise generally associated with such machines.

Venturi nozzle 11 includes venturi throat 112 for increasing the speed of a gas flow therethrough to sonic or near sonic velocity. The total throat area associated with muffler 10 is defined by the cross-sectional area of venturi throat 112. When muffler 10 includes more than one venturi nozzle 11, the total throat area is defined by the combined cross-sectional areas of venturi throats 112. In the embodiment of FIG. 1, inlet 121 of chamber 12 is connected to outlet opening 110 of the diverging outlet section of venturi nozzle 11 (i.e., the section between venturi throat 112 and outlet opening 110). Thus, chamber inlet 121 and outlet opening 110 are referenced to the same dashed line in FIG. 1. At the opposite end from outlet opening 110, is inlet opening 111 of the converging inlet section of venturi nozzle 11 (i.e., the section between inlet opening 110 and venturi throat 112). Inlet opening 111 (indicated by the dashed line tagged with reference numeral 111) generally opens to an intake gas source (e.g., the atmosphere for intake of air).

Briefly, during the intake action of the machine connected to intake 20, venturi nozzle 11 delivers gas to chamber 12 with a minimum loss while increasing the gas velocity to sonic or near sonic velocity at venturi throat 112. Chamber 12 serves as a reservoir of intake gas for the machine to draw from when there is inadequate flow through venturi throat 112.

A venturi nozzle, if closely coupled to a machine intake, may cause a large drop in capacity because flow is limited by choke conditions at the venturi throat during much of the intake cycle. Chamber 12 is sized to provide an adequate flow of air into the machine during the intake cycle when flow may be choked at venturi throat 112. Thus, to prevent loss of compression efficiency for a compressor, or charge efficiency for an engine, chamber 12 must be sized to provide an adequate supply of intake gas to chamber outlet 120 during the machine's intake stoke or action. When gas flow through venturi throat 112 becomes inadequate during the machine's intake cycle, the machine can draw from the reserve gas volume provided by intake 20 and venturi muffler 10.

The reserve gas volume provided by venturi muffler 10 includes the volumes of chamber 12 and the diverging outlet section of venturi nozzle 11 (i.e., the volume between venturi throat 112 and outlet opening 110). The total reserve volume (which includes the volume of intake 20) must be sized to compensate for any inadequate flow through venturi throat 112. Thus, the size of venturi muffler 10 is predicated upon how continuous the gas flow is into the machine. For machines with discontinuous intake flow, such as a single-acting reciprocating compressor, the total reserve volume should be approximately 10 times greater than the volume of gas required for each intake stroke. For machines that have a more continuous intake flow, such as a screw-type compressor or multi-cylinder engine, the total reserve volume should be approximately 3 times greater than the volume of gas require during each gas intake phase. For machines characterized by continuous non-fluctuating intake flow, such as turbomachinery, the reserve volume provided by the divergent outlet section of venturi nozzle 11 residing between venturi throat 112 and divergent outlet opening 110 is generally sufficient.

Venturi muffler 10 provides attenuation of noise associated with the machine's intake of air or other gases through two principles. First, the area defined by venturi throat 112 is sized to increase the speed of the gas flowing therethrough to sonic or near sonic velocity during each intake cycle. This is done because sound cannot propagate upstream past venturi throat 112 (towards inlet opening 111) as long as the downstream gas velocity therethrough (towards outlet opening 110) is in the sonic range. Second, the pressure fluctuations emanating from a machine intake are produced by abrupt changes of flow into the machine. A correctly sized venturi nozzle 11 will maintain relatively constant flow, thereby greatly reducing pressure fluctuations generated as gas is drawn into the machine during the machine's intake cycle. For machines with a discontinuous intake flow, such as a single-acting reciprocating compressor, venturi throat 112 is sized to achieve an average throat velocity of about 0.7 times sonic velocity. For machines that have a more continuous intake flow, such as a screw-type compressor or multi-cylinder engine, venturi throat 112 is sized to achieve an average throat velocity of about 0.9 times sonic velocity. For machines having continuous non-fluctuating intake flow, such as turbomachinery, venturi throat 112 is sized to achieve sonic velocity therethrough.

Generally, the angle and length of walls 113 and 114 leading to and from, respectively, venturi throat 112 are selected in accordance with standard venturi nozzle design criteria as is well understood in the art. In one embodiment, the angles and lengths of walls 113 and 114 are selected such that the flow areas defined by inlet opening 111, outlet opening 110 (and that defined by chamber inlet 121 in the embodiment of FIG. 1), and chamber outlet 120, are substantially equal to the flow area of intake 20. Alternatively, the length of walls 113 and 114 can be shortened along with proportional reductions in the respective diameters of inlet opening 111 and outlet opening 110. Note that while this alternative can cause some additional pressure drop across venturi nozzle 11, there is no loss in acoustic effectiveness.

Figure 2:
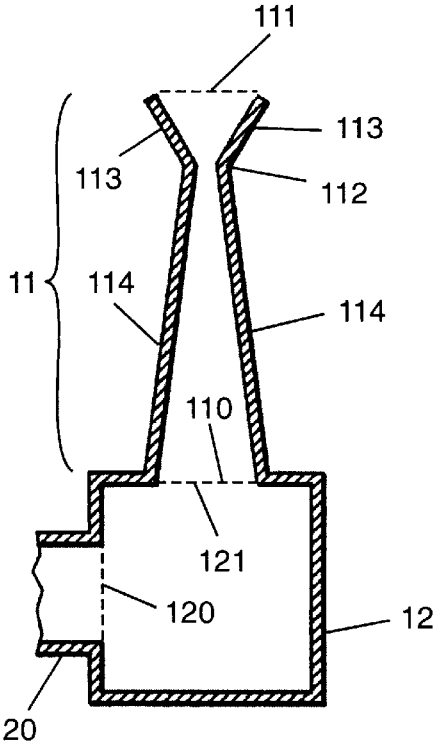
FIG. 2 is a side, cross-sectional view of a muffler according to another embodiment of the present invention.

Although the present invention has been described for the general embodiment of FIG. 1, it is not so limited. For example, venturi nozzle 11 and chamber 12 in FIG. 1 are arranged so that inlet opening 111, outlet opening 110 (and chamber inlet 121 in the embodiment of FIG. 1), and chamber outlet 120 are all aligned along a common axis (indicated by the dashed line tagged with reference numeral 200). However, space or other constraints may require that venturi nozzle 11 cooperate with chamber 12 in such a way that all openings through venturi nozzle 11, chamber 12 and intake 20 are not aligned with one another. One such scenario of this sort is represented by the embodiment shown in FIG. 2 where like reference numerals have been used for those elements in common with FIG. 1. In FIG. 2, outlet opening 110 of venturi nozzle 11 is positioned perpendicular to that of chamber outlet 120 leading to intake 20. Naturally, outlet opening 110 and chamber outlet 120 can form other angles with respect to one another depending on space or other constraints.

Figure 3:
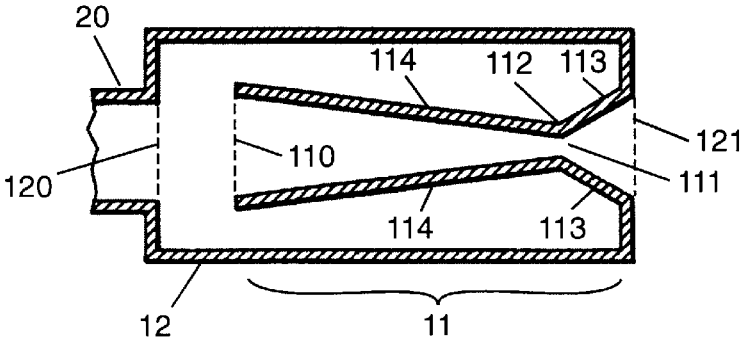
FIG. 3 is a side, cross-sectional view of a muffler according to yet another embodiment of the present invention.

In still another embodiment of the present invention, as shown in FIG. 3, venturi nozzle 11 can be enclosed within chamber 12 for a more compact design. In FIG. 3 like reference numerals have been used for those elements in common with FIG. 1. To accomplish the compact design of FIG. 3, inlet opening 111 of venturi nozzle 11 is made coincident with that of chamber inlet 121. In such a configuration, outlet opening 110 of venturi nozzle 11 is located within chamber 12.

As stated earlier, muffler 10 includes means 115 for varying the total throat area associated with muffler 10. The total throat area of muffler 10 is defined by the cross-sectional area of venturi throat 112 (if one venturi nozzle 11 associated with muffler 10) or the sum of the cross-sectional areas of venturi throats 112 (if more than one venturi nozzle 11 associated with muffler 10). A variable throat area allows a single design of muffler 10 to be optimized for particular machines. For example, different sized compressors have different capacities, i.e., amount of gas taken in during an intake cycle, at their design operating conditions. By having a variable throat area, one muffler design is suitable for use with various machines having a range of capacities. Additionally, variable speed compressors will have a variable intake flows, i.e., changing capacity, at different operating speeds. By having a variable throat area, one muffler design is able to be optimized for a machine having a variable intake flow. Thus, when the capacity of the compressor changes due to changing size or speed, muffler performance could be optimized for each machine or flow condition by adjusting the total throat area to maintain the optimum flow speed at venturi throat 112. When the desired throat speed is known (examples of optimum throat speed for various machines are given above), the required area of venturi throat 112 may be determined by methods well known in the art.

Figure 4:
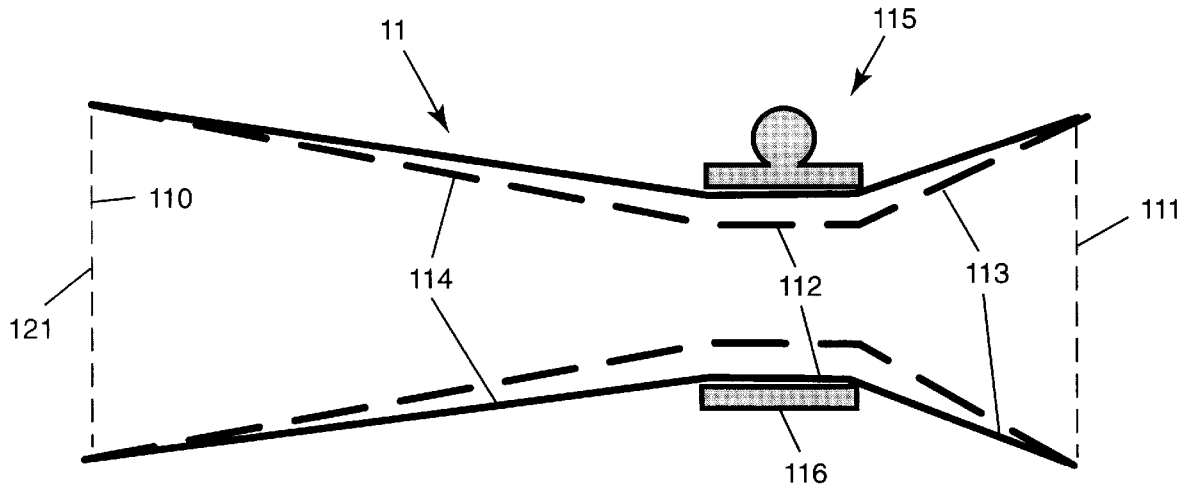
FIG. 4 is a side, cross-sectional view of one embodiment of a muffler in accordance with the present invention showing a venturi nozzle with variable throat area.

As shown in FIG. 4, muffler 10 includes at least one venturi nozzle 11 made of a flexible elastic material. Preferably, venturi throat 112 corresponding to each flexible venturi nozzle 11 is circular in cross-section. In this embodiment of muffler 10, means 115 for varying the total throat area include an adjustable band, collar or ring 116 surrounding each venturi throat 112 for constricting venturi throat 112.

Figure 5:
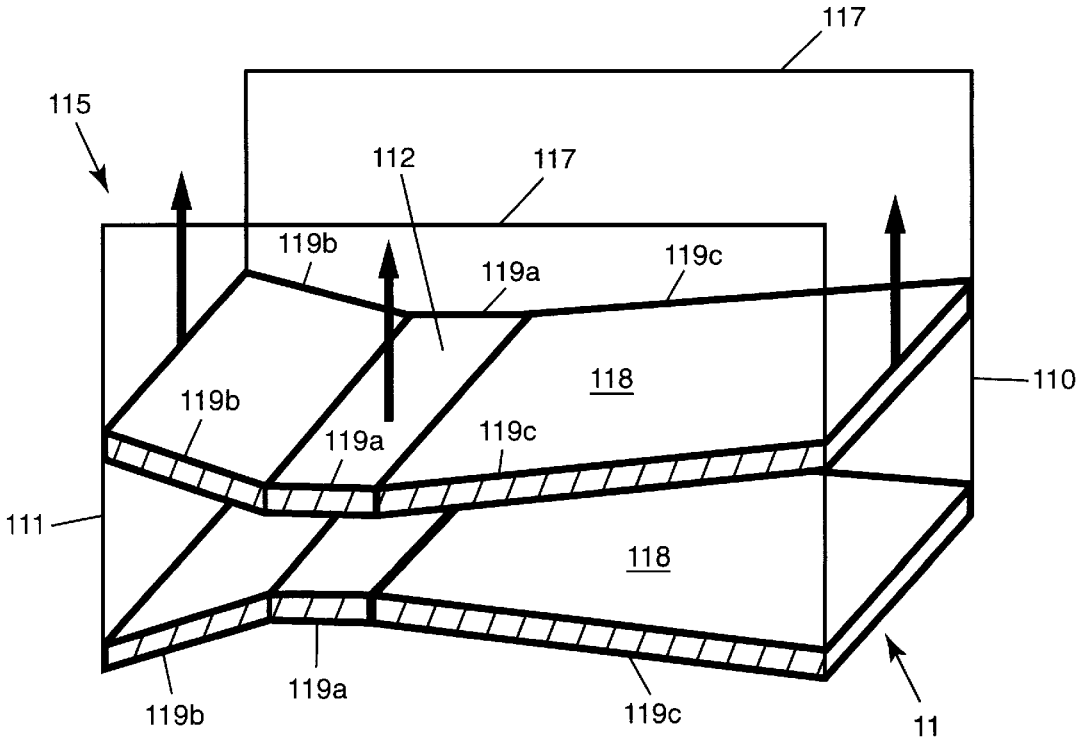
FIG. 5 is a side, cross-sectional view of another embodiment of a muffler in accordance with the present invention showing a venturi nozzle with variable throat area.

As shown in FIG. 5, each venturi nozzle 11 includes first and second parallel sides 117, and first and second flared sides 118 orthogonal to parallel sides 117. First and second flared sides 117 have parallel section 119*a* defining a corresponding venturi throat 112, convergent section 119*b* extending from a corresponding inlet opening 111 to a corresponding venturi throat 112, and divergent section 119*c* extending from a corresponding venturi throat 112 to a corresponding outlet opening 110. In this embodiment of muffler 10, means 115 for varying the total throat area include means (not shown) for moving at least one of first and second flared sides 118 towards a corresponding other one of first and second flared sides 118. Means for moving at least one of first and second flared sides 118 may include manually adjusting the relative positions of flared sides 118 or mechanically adjusting the position using means well known in the art for reciprocating movement, for example, by means of a double actuating hydraulic cylinder, or a rack-and-pinion gear type of linear actuator driven by an electric or hydraulic motor. Preferably, a muffler with a variable throat area as described in association with FIGS. 4 and 5 would have at least one venturi throat 112 that varied in cross-sectional area over a range of approximately 1 to 3.

Figure 6:
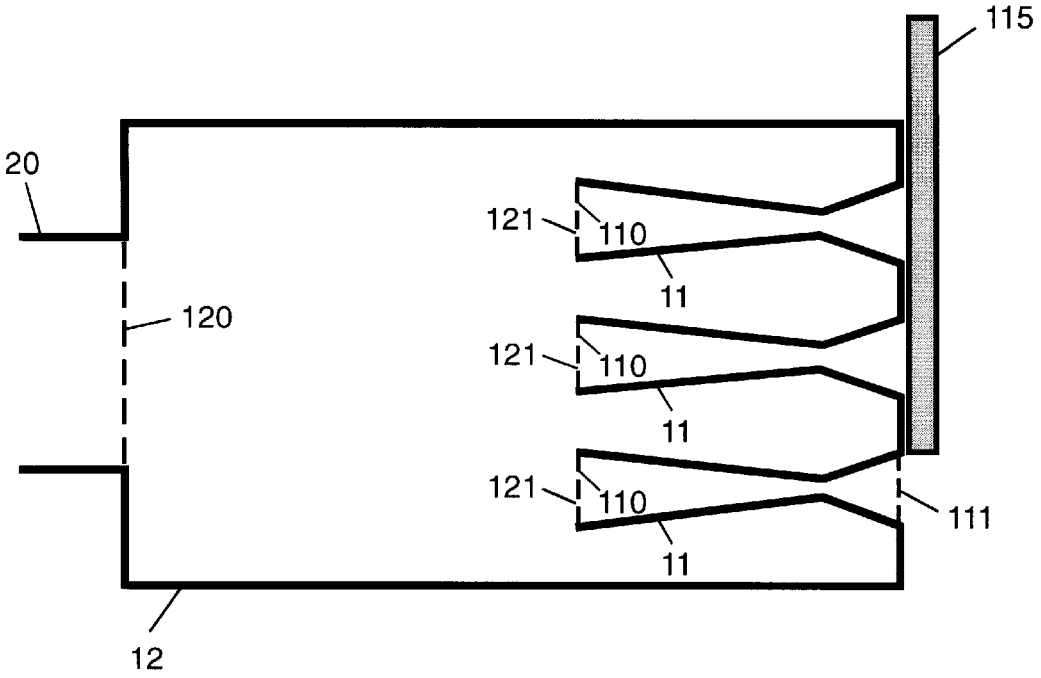
FIG. 6 is a side, cross-sectional view of a third embodiment of a muffler in accordance with the present invention having a variable throat area.

As shown in FIG. 6, venturi muffler 10 includes a plurality of venturi nozzles 11, each including corresponding inlet opening 111, outlet opening 110, and venturi throat 112 therebetween. Each venturi throat 112 has a cross-sectional area associated therewith wherein the total throat area of venturi muffler 10 is defined by the sum of the cross-sectional areas of the plurality of venturi nozzles 11. In this embodiment of muffler 10, means 115 for varying the total throat area include means for closing inlet opening 111 of at least one of plurality of venturi nozzles 11. Once the maximum desired total throat area is determined, muffler 10 is designed having a plurality of venturi nozzles 11 each having a cross-sectional area at throat 112 of a desired percentage of the total throat area. Generally, muffler 10 would include in the range of 5 to 10 venturi nozzles. However, a larger or smaller number could be used according to the level of adjustment desired. Furthermore, the cross-sectional area of each nozzle 11 could be equal or unequal depending on the number of nozzles desired or practicable for a given muffler size. For example, if 10 equal sized nozzles 11 (each 10% of the total throat area) were used, total throat area of muffler 10 could be varied in 10 percent increments by closing inlet opening 111 of one or more nozzles 11. Alternatively, by having 5 nozzles 11 having cross-sectional areas at throat 112 of 5, 10, 15, 20 and 50% of the total throat area, respectively, the total throat area could be varied in 5% increments by opening and closing varying permutations of nozzles 11. The advantage of using a smaller number of unequal sized nozzles is that frictional losses are decreased relative to a muffler with more nozzles.

Figure 7:
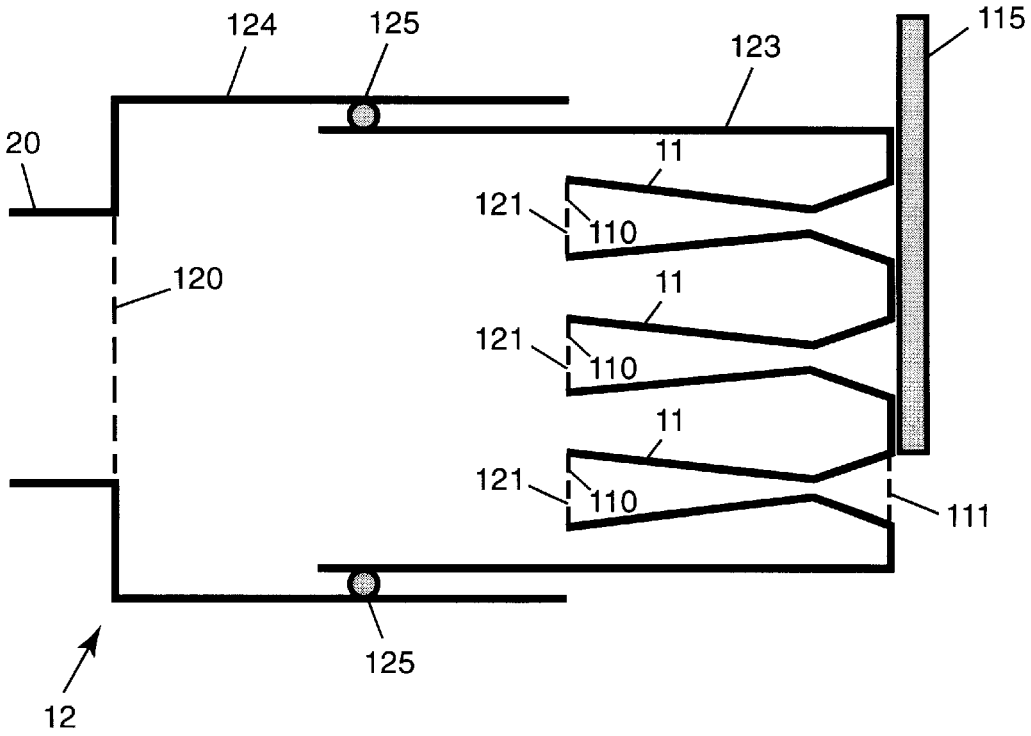
FIG. 7 is a side, cross-sectional view of one embodiment of a muffler in accordance with the present invention having a variable throat area and a variable chamber volume.

In a further embodiment, muffler 10 becomes a variable volume muffler by including means for varying the volume of chamber 12. A variable chamber volume allows a single design of muffler 12 to be used on different types of machines requiring different volumes of reserve gas for efficient operation. For example, as described above, the required volume of chamber 12 is less for a screw compressor than for a reciprocating compressor of the same capacity. An exemplary embodiment of variable volume muffler 10 is shown in FIG. 7, wherein chamber 12 is divided into two slidably engaging sections. First section 123 is adjacent to and attached to venturi nozzle 11. Second section 124 is adjacent to and attached to machine intake 20. As shown in FIG. 7, second section 124 overlaps first section 123, however, the opposite arrangement, i,e, first section 123 overlapping second section 124, would function identically. Disposed between the overlapping segments of first and second sections 123, 124 is sealing means 125, such as an 0-ring, gasket or other suitable sealing means for creating an airtight, slidable seal. Therefore, the volume of muffler 12 can be easily adjusted for use with different machines by mechanically adjusting (using, e.g., means well known in the art for reciprocating movement) or physically (manually) sliding first and second sections 123, 124 relative to each other and then locking them in place using means well known in the art.

The advantages of the present invention are numerous. A muffler built in accordance with the present invention attenuated intake noise of a reciprocating compressor by 15–29 dB over the 15–350 Hz frequency range (i.e., the frequency range over which the intake noise of reciprocating compressors is prominent). Another muffler built in accordance with the present invention attenuated intake noise of a screw compressor 7–9 dB more than a much heavier and larger commercial muffler at frequencies below 350 Hz. In both cases, attenuation was achieved with no more pressure drop than caused by a conventional reactive or dissipative muffler.

Multiple nozzles should be useful in reducing muffler manufacturing costs. For example, a plate may be produced, by casting or molding, having closely spaced parallel nozzles opening through the plate. A section of plate, containing the required number of nozzles, could be cut out for use with a particular nozzle. The plate could be incorporated as a wall of the muffler having nozzle openings passing therethrough.

The present invention and many of its attendant advantages will be understood from the foregoing description and it will be apparent to those skilled in the art to which the invention relates that various modifications may be made in the form, construction and arrangement of the elements of the invention described herein without departing from the spirit and scope of the invention or sacrificing all of its material advantages. For example, while venturi nozzles are typically circular in cross-section, the present invention would work equally well with venturi nozzles having other cross-sectional shapes such as rectangular (e.g., FIG. 5) or polygonal. It is therefore to be understood, the forms of the present invention herein described are not intended to be limiting but are merely preferred or exemplary embodiments thereof and, within the scope of the appended claims, the invention may be practiced other than as specifically described.

What is claimed is:

1. A muffler for connecting to a gas intake of a machine which produces noise while taking in a gas flow through said gas intake, said muffler comprising:

a venturi nozzle having an inlet opening, an outlet opening and a venturi throat therebetween, said venturi throat defining an approximately circular cross-sectional throat area, said venturi nozzle including flexible elastic material;

a chamber having a chamber inlet and a chamber outlet, said chamber inlet connected to one of said inlet opening and said outlet opening, said chamber outlet connected to said gas intake; and an adjustable collar for varying said approximately circular cross-sectional throat area, said adjustable collar surrounding said venturi throat.

2. A muffler as in claim 1, wherein said chamber inlet is connected to said inlet opening, and wherein said chamber encloses said venturi nozzle.

3. A muffler as in claim 1, wherein said chamber inlet is connected to said outlet opening, and wherein said venturi nozzle projects outside said chamber.

4. A muffler for attenuation of low frequency noise at a gas intake of a machine, said machine being of the type requiring a known volume of a gas at said gas intake during an intake cycle of said machine, the noise arising during each said intake cycle, said muffler comprising:

at least one venturi nozzle, each said venturi nozzle including, as particular thereto, an inlet opening, an outlet opening a throat passage between said inlet and outlet openings which defines a cross-sectional throat area, a converging section between said inlet opening and said throat passage, and a diverging section between said throat passage and said outlet opening;

a total throat area associated with said muffler, said total throat area being defined by the sum of every said cross-sectional throat area, each said cross-sectional throat area being defined by said throat passage particular to one said venturi nozzle;

means for varying said total throat area; and a chamber having a chamber inlet and a chamber outlet, said chamber inlet being connected to one of said inlet opening and said outlet opening which are particular to each said venturi nozzle, said chamber outlet being connected to said gas intakes;

wherein a flow of said gas reaches said gas intake by sequentially passing from each said inlet opening which is particular to one said venturi nozzle, through each said venturi nozzle, through each said outlet opening which is particular to one said venturi nozzle, through at least a portion of said chamber, and through said chamber outlets;

wherein at least one said venturi nozzle is made of a flexible elastic material and has a particular said throat passage which is approximately circular in cross-section; and wherein said means for varying said total throat area includes at least one adjustable collar, each said adjustable collar being for varying one said cross-sectional throat area, each said adjustable collar surrounding one said throat passage which is approximately circular in cross-section and which is particular to one said venturi nozzle which is made of a flexible elastic material.

5. A muffler as in claim 4, wherein:

said muffler comprises one said venturi nozzle;

said throat passage which is particular to said venturi nozzle is sized to increase an average speed of a flow of said gas to between about 0.7 times sonic velocity and sonic velocity; and said chamber and said diverging section of said venturi nozzle enclose a volume equal to between about 1 and 10 times said known volume.

6. A muffler as in claim 4 wherein each said outlet opening which is particular to one said venturi nozzle is connected to said chamber inlet, and wherein each said venturi nozzle projects outside said chamber.

7. A muffler as in claim 4, wherein each said inlet opening which is particular to one said venturi nozzle is connected to said chamber inlet, and wherein said chamber encloses each said venturi nozzle.

8. A muffler for attenuating noise of a machine having a gas intake, said muffler comprising:

at least one venturi nozzle having a throat portion axially intermediate an inlet opening and an outlet opening, said throat portion defining a cross-sectional throat perimeter which bounds a cross-sectional throat area;

a chamber having a chamber inlet and a chamber outlet, said chamber engaging each said venturi nozzle by connecting said chamber inlet to either of said inlet opening and said outlet opening, said chamber engaging said machine by connecting said chamber outlet to said gas intake; and means for structurally altering at least one said throat portion so as to modify said cross-sectional throat perimeter which said throat portion defines and thereby vary said cross-sectional throat area which said cross-sectional throat perimeter bounds.

9. A muffler as in claim 8, wherein:

at least one said venturi nozzle has a flexible said throat portion which defines a curvilinear said cross-sectional throat perimeter; and said means for structurally altering includes means for constricting and deconstricting at least one said flexible curvilinear throat portion, said means for constricting and deconstricting including an adjustable collar for surrounding a said flexible said throat portion which defines a curvilinear said cross-sectional throat perimeter.

10. A muffler as in claim 8, wherein, for at least one said throat portion, said means for structurally altering is over an approximate range of one to three times said cross-sectional throat area.

11. A muffler as in claim 8, wherein:

at least one said venturi nozzle includes a pair of opposite flared sides and a pair of opposite approximately parallel approximately planar sides, said flared sides being approximately orthogonal with respect to said approximately planar sides, whereby said venturi nozzle has a said throat portion which is approximately rectangular in cross-section;

each said pair of flared sides includes three pairs of corresponding sections of said flared sides, a first pair of said sections being approximately parallel and forming two sides of said throat portion, a second pair of said sections convergently extending from said inlet opening to said throat portion, a third pair of said sections divergently extending from said throat portion to said outlet opening; and said means for structurally altering at least one said throat portion includes means for relatively positioning said pair of opposite flared sides, said means for relatively positioning said pair of opposite flared sides including means for moving at least one of said flared sides toward the other of said flared sides.

12. A muffler as in claim 8, wherein said muffler is characterized by a total throat area, wherein said total throat area is defined by the aggregate of every said cross-sectional throat area which is bounded by a said cross-sectional throat perimeter, wherein said muffler includes means for varying said total throat area, and wherein said means for varying said total throat area includes said means for structurally altering at least one said throat portion.

13. A muffler as in claim 8, wherein:

each said throat passage defines a said cross-sectional throat perimeter which is of a form selected from the group consisting of curvilinear and rectilinear.

* * * * *